United States Patent [19]

Gonnering et al.

[11] Patent Number: 4,995,357

[45] Date of Patent: Feb. 26, 1991

[54] ENGINE SHUT-OFF CIRCUIT

[75] Inventors: John B. Gonnering, West Bend; Paul A. Tharman, Milwaukee, both of Wis.

[73] Assignee: Briggs & Stratton Corporation, Wauwatosa, Wis.

[21] Appl. No.: 435,284

[22] Filed: Nov. 13, 1989

[51] Int. Cl.[5] ..... F02B 77/00

[52] U.S. Cl. ..... 123/198 DC; 123/196 S

[58] Field of Search ..... 123/198 DC, 196 S, 630; 184/108

[56] References Cited

U.S. PATENT DOCUMENTS

| | | | |
|---|---|---|---|
| 1,163,919 | 12/1915 | Herb et al. | 123/196 S |
| 2,722,673 | 11/1955 | Turner | 340/60 X |
| 3,356,082 | 12/1967 | Jukes | 123/335 |
| 3,484,677 | 12/1969 | Piteo | 123/184 E |
| 3,521,612 | 7/1970 | Santi et al. | 123/179 K |
| 3,581,720 | 6/1971 | Hemphill et al. | 123/118 |
| 3,601,103 | 8/1971 | Swiden | 123/198 D |
| 3,726,265 | 4/1973 | Howard | 123/179 K |
| 3,731,471 | 5/1973 | Bening | 56/10.5 |
| 3,733,794 | 5/1973 | Allen | 56/10.5 |
| 3,782,084 | 1/1974 | Harkness | 56/10.5 |
| 4,003,190 | 1/1977 | Braun et al. | 56/10.5 |
| 4,033,311 | 7/1977 | Burson | 123/179 K |
| 4,034,732 | 7/1977 | Van Burkleo | 123/198 D |
| 4,054,117 | 10/1977 | Palmer et al. | 123/198 D |
| 4,059,089 | 11/1977 | Tanigami et al. | 123/196 S |
| 4,073,279 | 3/1978 | Fox | 123/198 DC |
| 4,120,277 | 10/1978 | Ehlen | 123/148 CC |
| 4,144,862 | 3/1979 | Estkowski | 123/196 S |
| 4,147,151 | 4/1979 | Wright | 123/198 DC |
| 4,181,206 | 1/1980 | Seilenbinder | 192/0.084 |
| 4,270,509 | 6/1981 | Tharman | 123/647 |
| 4,294,327 | 10/1981 | Howard | 123/198 DC |
| 4,369,745 | 1/1983 | Howard | 123/198 DC |
| 4,445,470 | 5/1984 | Chmielewski | 123/196 S |
| 4,489,311 | 12/1984 | Lang et al. | 180/179 |
| 4,492,197 | 1/1985 | Yamamoto et al. | 123/198 DC |
| 4,522,170 | 6/1985 | Lenk et al. | 123/198 DC |
| 4,622,935 | 11/1986 | Janisch | 123/198 DC |
| 4,684,917 | 8/1987 | Tharman | 123/198 D |
| 4,754,732 | 7/1988 | Kuczenski et al. | 123/196 S |

FOREIGN PATENT DOCUMENTS

| | | | |
|---|---|---|---|
| 148969 | 11/1980 | Japan | 123/198 DC |
| 57-200671 | 12/1982 | Japan | 123/630 |

*Primary Examiner*—Noah P. Kamen

*Attorney, Agent, or Firm*—Andrus, Sceales, Starke & Sawall

[57] ABSTRACT

An ignition-powered engine shut-off circuit is provided for power-driven apparatus such as lawn mowers, pumps, generators, tractors and the like. The shut-off circuit preferably includes a first switch, such as a low oil or toggle switch, which is activated when a particular condition exists. The circuit also includes an electronic switch that is subject to the control of a switch control means. When the first switch senses that a particular condition exists, the switch control means gates on the electronic switch, grounding the ignition pulses and shutting off the engine. The first switch is preferably a reed switch used to sense low oil levels, and the electronic switch is preferably a high-power SCR or other thyristor. An indicator means consisting of an LED and a shunt resistor indicates that the ignition pulses are being grounded.

4 Claims, 2 Drawing Sheets

ENGINE SHUT-OFF CIRCUIT

BACKGROUND OF THE INVENTION

The present invention relates to switch circuits which shut off an engine, and more particularly to circuits for shutting off engines when a low oil condition exists.

Various types of circuits are known for shutting off an engine when a particular condition exists, such as low oil or low oil pressure in the crankcase, or when a sufficient pressure is not present on the seat of a riding vehicle. Some of these prior art switch circuits are connected to indicator systems that provide an audible or visual signal when, for example, the oil pressure is too low.

One known low oil switch has one terminal connected to a float which floats near the surface of the oil in the crankcase. The other terminal is typically affixed to the bottom of the crankcase and is connected to ground. When the oil level drops below a predetermined level, the floating terminal contacts the terminal at the bottom of the crankcase, shorting ignition pulses to ground and shutting off the engine.

A major problem with this prior art device is that the float switch arrangement is very expensive, increasing the cost of the engine.

Therefore, it is desirable to design an engine shut-off circuit that is both simple and inexpensive.

SUMMARY OF THE INVENTION

An ignition-powered engine shut-off circuit is provided for power-driven apparatus such as lawn mowers, pumps, generators, tractors and the like having an internal combustion engine. The engine includes a crankcase containing oil and an ignition system that has a main core. The main core includes a primary winding for producing ignition pulses.

In its broadest embodiment, the present invention includes a first switch that is activated when a particular condition exists, such as low oil pressure, low oil level, insufficient pressure on the seat of a riding vehicle, or that a manual switch is in its ON position. An electronic switch connected in circuit with the primary winding is controlled by a switch control means. The switch control means is connected in circuit with both the first switch and with the electronic switch, and turns on the electronic switch to ground the ignition pulses and thereby shut off the engine when the first switch is activated. The first switch may be a normally open or a normally closed type of switch, so that activation of the first switch consists of closing or opening the first switch, respectively. An indicator means is also provided for indicating that the ignition pulses are being grounded.

The electronic switch may be a silicon-controlled rectifier (SCR), and the switch control means may be a voltage divider consisting of a pair of resistors. The electronic switch may also be a thyristor. The indicator means may be a buzzer, or a light emitting diode and shunt resistor.

In a preferred embodiment, the first switch is a low oil switch means for sensing when the amount of oil in the crankcase is below a predetermined level. When the low oil switch means senses that the engine oil level is in fact below the predetermined level, the first switch is activated. The switch control means then turns on the electronic switch to ground the ignition pulses and thus shut off the engine. The low oil switch means preferably includes a reed switch.

It is a feature and advantage of the present invention to increase the safety of internal combustion engines.

It is yet another feature and advantage of the present invention to provide a simple and inexpensive shut-off circuit for an internal combustion engine.

These and other features and advantages of the present invention will be apparent to those skilled in the art from the following detailed description and the attached drawings, in which:

DESCRIPTION OF THE PREFERRED EMBODIMENTS

Figure 1:
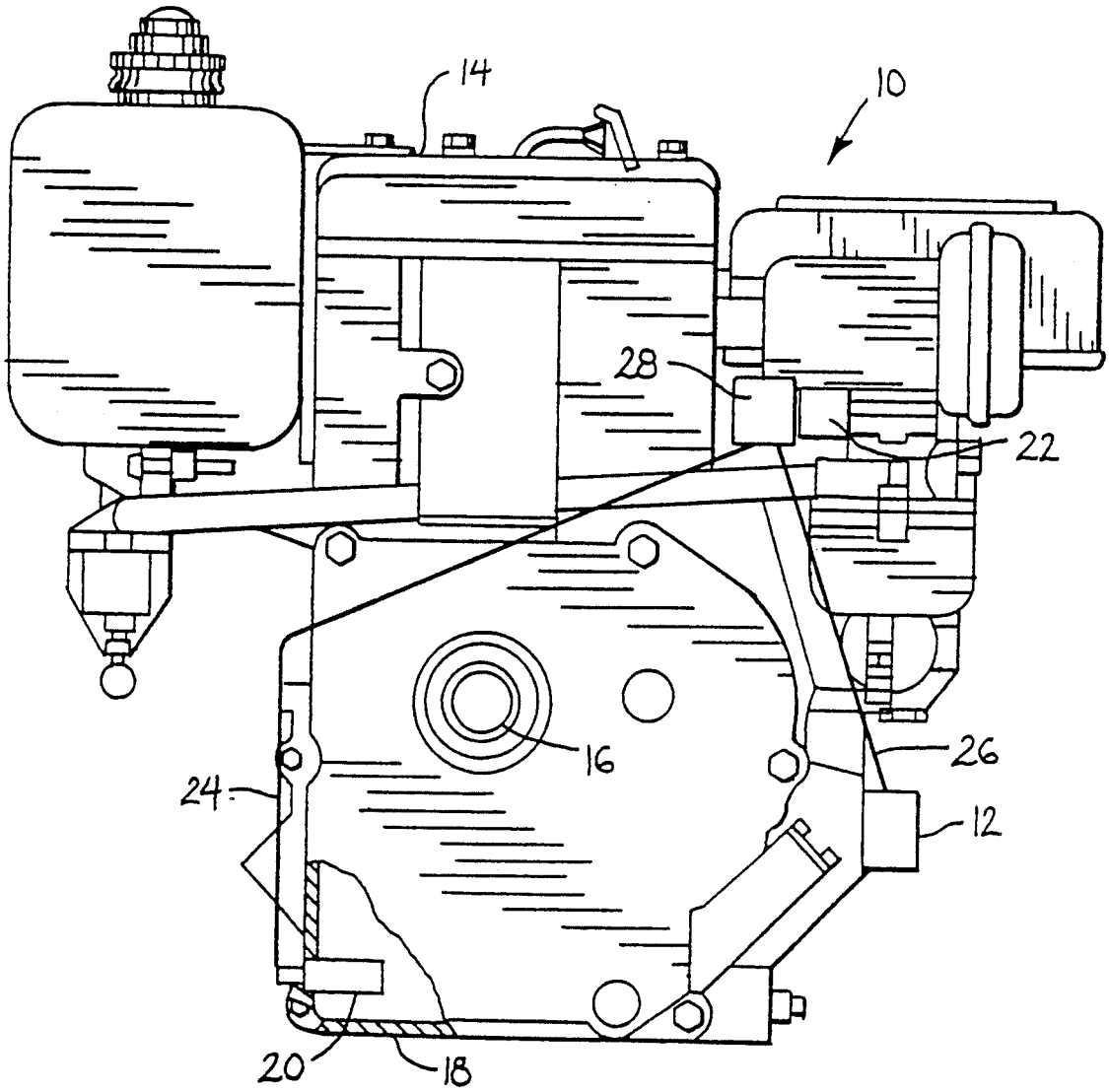
FIG. 1 is a schematic drawing of a generator incorporating the embodiment of the engine shut-off circuit of the present invention depicted in FIG. 2.

Referring now to FIG. 1, the principles of the invention are illustrated as being applied to a breakerless magneto-ignition system for a single cylinder internal combustion engine 14 that drives a generator 10. Although the principles of the invention are illustrated as being applied to magneto-ignition systems of the type used for powering tractors, lawn mowers, pumps, electrical generators, snow blowers and the like, the invention may be used with battery powered ignition systems as well.

The ignition system of FIG. 1 includes a conventional magneto armature (not shown) having an induction coil consisting of a primary winding 12 that has a relatively small number of turns of relatively coarse wire, and a secondary winding (not shown) having numerous turns of relatively fine wire. The primary and secondary windings are inductively coupled with one another in a conventional manner by means of a ferromagnetic core (not shown) on which they are both wound. A spark plug (not shown) is connected across the terminals of the secondary winding. Although the invention is illustrated as being applied to a single cylinder internal combustion engine having only one spark plug, the invention may be used with inventions having a plurality of spark plugs successively connected with the secondary winding in a known manner by means of a conventional distributor used with multicylinder engines.

To fire the spark plug, a circuit is closed to permit current to flow in the primary winding. That circuit remains closed at least long enough for the current flow in the primary winding to attain its full value, and is abruptly opened at the time the spark plug is to be fired, yielding a rapid collapse of the flux field that had been induced in the core by the current flow. The collapsing flux induces across the secondary winding a voltage high enough to produce an arc across the electrode to the spark plug, in a conventional manner.

Assuming that the present invention is incorporated into a single cylinder engine having a breakerless magneto-ignition system, the operation of the magneto requires that a circuit between the terminals of the primary winding be closed and opened by switching means operated in properly timed relation to the engine cycle.

In the breakerless magneto-ignition system, mechanically actuated breaker points for controlling the flow of current to the primary winding are replaced by electronic switching means comprising a transistor device (not shown) and a small biasing or trigger coil (not shown) wound upon a second ferromagnetic core (not shown). The biasing coil and its corresponding second core cooperate with a permanent magnet assembly carried for orbital motion on a flywheel mounted on the engine crankshaft. The crankshaft rotates in timed relation to the engine cycle. The operation of the transistor device and biasing coil in cooperation with the armature coil and permanent magnet assembly are described in detail in U.S Pat. No. 4,270,509 to Paul A. Tharman, the subject thereof being specifically incorporated by reference herein.

Referring again to FIG. 1, generator 10 typically includes an internal combustion engine 14 having a crankshaft 16 and a crankcase 18 that contains oil or another lubricant for engine 14.

Figure 2:
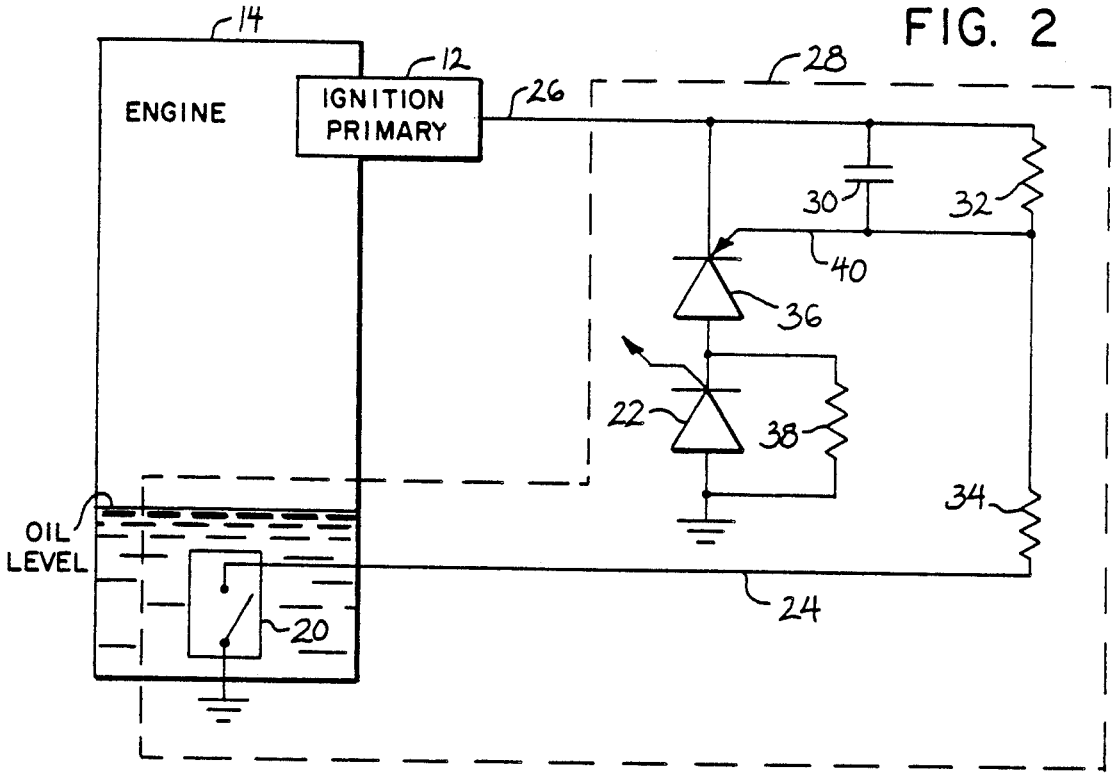
FIG. 2 is a schematic drawing of a preferred embodiment of the present invention having a normally open low oil level reed switch.
Figure 3:
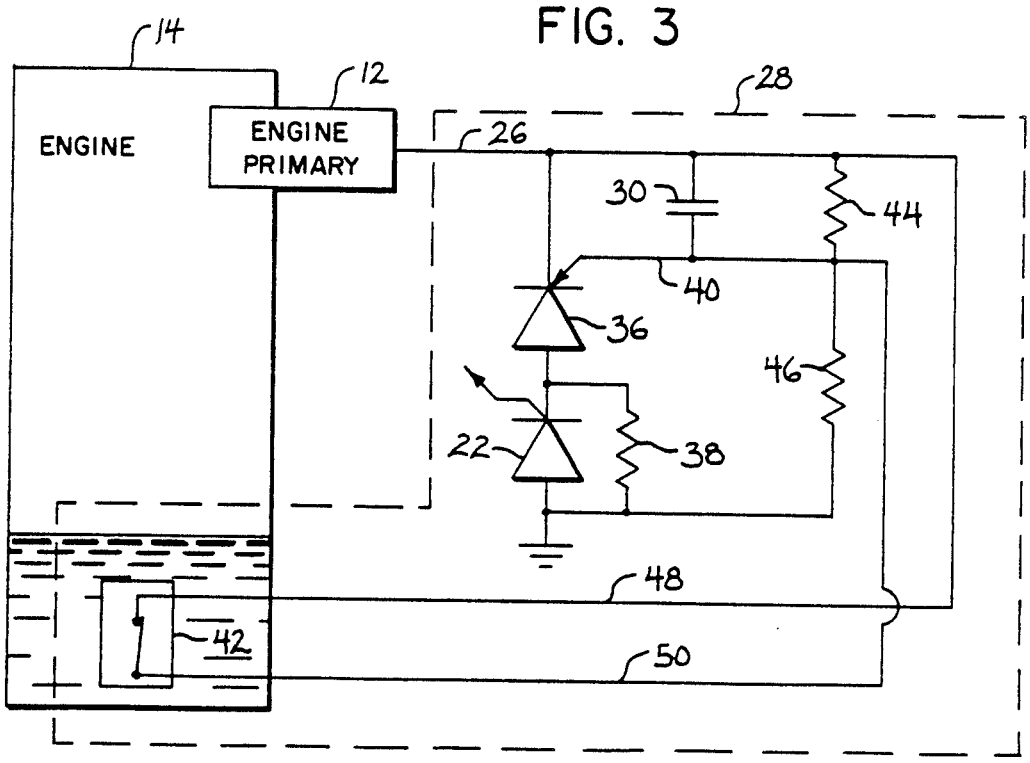
FIG. 3 is a schematic drawing of a preferred embodiment having a normally closed low oil level reed switch.

Although the generator of FIG. 1 includes the embodiment of the present invention depicted in FIG. 2, the embodiment depicted in FIG. 3 may also be used with the above-described generator.

In FIG. 1, an ignition pulse from ignition primary 12 powers shut-off switch circuit 28 via line 26. Indicator means 22 connected in series with shut-off circuit 28 may consist of a buzzer, or an LED having a one ohm parallel shunt resistor to protect the LED from the high current in the ignition pulse. Oil crankcase 18 includes an oil level switch means 20 that is also connected to shut-off circuit 28 and LED 22 via line 24. Oil level switch means 20 typically senses the crankcase oil level and closes when the oil level in crankcase 18 is below a predetermined level.

FIG. 2 depicts a preferred embodiment of the present invention using a normally open low oil level switch means 20 as the first switch. Referring now to FIG. 2, the high voltage side of ignition primary winding 12 of engine 14 is connected in series with and powers shut-off circuit 28 via line 26. Shut-off circuit 28 includes a capacitor 30, a voltage divider consisting of resistors 32 and 34, a silicon-controlled rectifier (SCR) 36, LED 22, a shunt resistor 38 connected across LED 22, and a low oil level reed switch 20. The low oil switch means, reed switch 20, senses when the amount or level of oil in the crankcase is below a predetermined level, and activates by closing when that particular condition exists. Reed switch 20 could be replaced by a low oil pressure switch, a manually-operated switch that is activated when it is in the ON condition, or a seat switch that is activated when the pressure applied on the seat of the riding vehicle incorporating engine 14 is below a preset level.

Shut-off circuit 28 as depicted in FIG. 2 includes an SCR 36 as its electronic switch. SCR 36 could be replaced by a thyristor.

In the embodiment depicted in FIG. 2, a switch control means for turning on or otherwise controlling electronic switch 36 consists of a voltage divider. The voltage divider consisting of resistors 32 and 34 could be replaced by another voltage source for gating on electronic switch 36. Similarly, the indicator means consisting of LED 22 and parallel shunt resistor 38 could be replaced by another visual or audio indicator means and still be within the scope of the present invention. The purpose of the indicator means is to alert the operator that ignition pulses from ignition primary 12 are being grounded because the particular condition exists. In the embodiment depicted in FIG. 2, the particular condition is that the level of engine oil as sensed by first switch 20 is below a predetermined level. Capacitor 30 acts primarily as a noise filter.

The engine shut-off circuit depicted in FIG. 2 operates in the following manner. If reed switch 20 is open, meaning that the sensed oil level is adequate, any voltage signal present on line 40 is insufficent to gate on SCR 36; thus, SCR 36 is gated off. When SCR 36 is off, ignition pulses from ignition primary 12 are not grounded, and the engine 14 runs in the usual manner.

When low oil switch means 20 senses that the oil level in the engine crankcase is below a predetermined level, switch 20 closes. When switch 20 closes, a voltage signal develops across resistors 32 and 34, causing a voltage signal to gate on SCR 36 via line 40. The gating on of SCR 36 causes ignition pulses from ignition primary 12 to be grounded via line 26, SCR 36, LED 22, and shunt resistor 38. Although only a small voltage signal is necessary to gate on SCR 36, SCR 36 must be chosen so that it can handle approximately 2.5 amps of current for a single cylinder engine, which is the approximate amperage of ignition pulses from ignition primary 12. The 1 ohm shunt resistor 38 connected across LED 22 is designed to protect LED 22 from the high ignition pulse current. Reed switch 20 may only withstand a small current, on the order of milliamps. SCR 36 turns on when switch 20 closes, and remains on until all the energy from the ignition pulses ceases.

The use of a reed switch for electronic switch 20 significantly decreases the cost of engine shut-off circuit 28 when compared to the prior art devices. One terminal of reed switch 20 is connected to ground, with the other terminal being connected to the voltage divider via line 24. Although reed switch 20 is inexpensive and works somewhat better than prior art float type switches, it is unable to handle the large ignition pulses from ignition primary 12. That is, the ignition pulses cannot typically be grounded directly through reed switch 20 without burning up the reed switch. The present invention solves this problem by using a high power SCR 36 or other thyristor and a voltage divider as the switch control means for switch 36. By properly choosing the values of resistors 32 and 34, the amount of current passing through closed reed switch 20 is very small, as is the gating signal which gates on SCR 36 via line 40. Most of the ignition pulse current passes through high power SCR 36 to ground, thereby shutting off the engine. A suitable SCR is a Motorola MCR 100-8; resistor 32 would then have a value of about 1K and resistor 34 would have a value of about 150 ohms.

FIG. 3 depicts another embodiment of the present invention, in which a normally closed reed switch 42 is used. Components in FIG. 3 having corresponding functions to those in FIG. 2 have been given the same numerical designations.

The engine shut-off circuit depicted in FIG. 3 operates in the following manner. If reed switch 42 is closed, meaning that the sensed oil level is adequate, resistor 44 is shorted, so that any voltage signal present on line 40 is insufficient to gate on SCR 36. Thus, SCR 36 is gated off. When SCR 36 is off, ignition pulses from ignition primary 12 are not grounded and engine 14 runs in the usual manner.

When low oil switch means 42 senses that the oil level in the engine crankcase is below a predetermined level, switch 42 activates by opening. When switch 42 opens, a voltage develops across the voltage divider consisting of resistors 44 and 46, causing the voltage signal on line 40 to gate on SCR 36. The gating on of SCR 36 causes ignition pulses from ignition primary 12 to be grounded via line 26, SCR 36, LED 22, and shunt resistor 38. Capacitor 30 acts primarily as a noise filter.

In the embodiment depicted in FIG. 3, SCR 36 may be a Motorola MCR 100-8, but resistors 44 and 46 should have higher values than their counterparts, resistors 32 and 34 in FIG. 2. If an MCR 100-8 SCR is used, resistor 44 may have a value of about 3.3K, and resistor 46 of about 2.2K.

One terminal of switch 42 is connected to ignition primary 12 via lines 26 and 48, and the other terminal of switch 42 is connected to the voltage divider via line 50.

Several embodiments of the present invention have been discussed above and depicted in the drawings. However, additional alternate embodiments will be apparent to those skilled in the art and are contemplated as being within the scope of the present invention. Therefore, the scope of the present invention is to be limited only by the following claims.

I claim:

1. In an apparatus having an internal combustion engine including a crankcase containing oil and an ignition system having a main core that includes a primary winding to produce ignition pulses, the improvement of a circuit for shutting off the engine, comprising:

a first switch that is activated when a particular condition exists;

an electronic switch connected in circuit with said primary winding;

switch control means, connected in circuit with said first switch and with said electronic switch and including a voltage divider, for turning on said electronic switch to ground the ignition pulses and shut off said engine when said first switch is activated; and indicator means for indicating that the ignition pulses are being grounded said ignition system being grounded via said electronic switch and said indicator means when said electronic switch is on.

2. The improvement of claim 1, wherein said indicator means comprises:

a light emitting diode; and a shunt resistor.

3. In an apparatus having an internal combustion engine including a crankcase containing oil and an ignition system having a main core that includes a primary winding to produce ignition pulses, the improvement of a circuit for shutting off the engine when the engine oil level is below a predetermined level, comprising:

low oil switch means for sensing when the amount of oil in the crankcase is below the predetermined level;

an electronic switch connected in circuit with said primary winding;

switch control means, connected in circuit with said low oil switch means and with said electronic switch and including a voltage divider, for controlling said electronic switch to shut off said engine when said low oil switch means senses that the engine oil level is below the predetermined level; and indicator means for indicating when said engine oil level is below the predetermined level said ignition system being grounded via said electronic switch and said indicator means when said electronic switch is on.

4. The improvement of claim 3, wherein said indicator means comprises:

a light emitting diode; and a shunt resistor.

* * * * *